US005882583A

United States Patent [19]

Erny

[11] Patent Number: 5,882,583

[45] Date of Patent: Mar. 16, 1999

[54] PRECAST MODULE LEVELING ASSEMBLY FOR A METALLURGICAL VESSEL

[75] Inventor: Edward L. Erny, Bethel Park, Pa.

[73] Assignee: Harbison-Walker Refractories Company, Pittsburg, Pa.

[21] Appl. No.: 872,830

[22] Filed: Jun. 11, 1997

Related U.S. Application Data

[63] Continuation-in-part of Ser. No. 589,709, Jan. 22, 1996, Pat. No. 5,824,263.

[51] Int. Cl.[6] ..... C21B 7/04

[52] U.S. Cl. ..... 266/283; 266/280

[58] Field of Search ..... 266/283, 280, 266/275; 52/596, 604, 612, 249; D25/113, 151

[56] References Cited

U.S. PATENT DOCUMENTS

| | | | |
|---|---|---|---|
| 229,724 | 7/1880 | Mann et al. | 52/249 |
| 2,526,289 | 10/1950 | Griffith | 52/249 |
| 3,516,478 | 6/1970 | Dunn et al. | 164/281 |
| 3,695,604 | 10/1972 | Hermann | 266/43 |
| 3,972,516 | 8/1976 | Nicholas | 266/283 |
| 4,746,102 | 5/1988 | Gilles et al. | 266/236 |
| 5,196,051 | 3/1993 | Heaslip et al. | 75/582 |

FOREIGN PATENT DOCUMENTS 1 188 073 6/1985 Canada .

OTHER PUBLICATIONS

Shamva Catalog No. 102, Mullite Refractory Brick and Special Shapes, H.k. Porter Company, Inc. pp. 5–23, especially p. 22, dated Jan. 02, 1958.

*Primary Examiner*—Scott Kastler
*Attorney, Agent, or Firm*—Craig G. Cochenour

[57] ABSTRACT

An interconnected precast module refractory leveling assembly for a metallurgical vessel is disclosed. The precast modules of the instant invention compensate for the sloping bottom of a metallurgical vessel. At least one precast module is disposed in each of two partial rings each of which is essentially a mirror image of the other so that the height of the leveling assembly varies substantially uniformly from a high point where the two mirror image portions join to a low point 180 degrees of arc displaced therefrom where the two portions again join. Each of the refractory precast modules has a slight taper in height so that the ends of each precast module are the same height as the juxtaposed ends of the adjoining precast module.

18 Claims, 7 Drawing Sheets

PRECAST MODULE LEVELING ASSEMBLY FOR A METALLURGICAL VESSEL

CROSS REFERENCE TO RELATED APPLICATIONS

This application is a Continuation-in-part (under 37 C.F.R. §1.53) of U.S. Pat. application Ser. No. 08/589,709 filed Jan. 22, 1996 now U.S. Pat. No. 5,824,263.The entirety of such patent application is specifically incorporated herein by reference.

BACKGROUND OF THE INVENTION

1. Field of Invention

This invention relates to high temperature refractories and more particularly to a precast module or a plurality of precast modules of refractories for use as a leveling assembly in metallurgical vessels with sloping bottoms.

2. Brief Description

As will be recognized by those skilled in the art, in high temperature vessels such as molten steel ladles, one problem heretofore encountered relates to preventing slag from contaminating or otherwise being mixed with the relatively pure steel when it is being withdrawn from the vessel. Since slag is less dense than the molten steel, the slag tends to rise and accumulate on top of the underlying steel. If a pouring orifice is provided in the bottom of the vessel, relatively uncontaminated molten steel can be withdrawn simply by opening the orifice to permit the liquid steel to exit therethrough. However, when the liquid surface falls until it is near the bottom of the vessel, pouring must stop before slag exits along with the remaining steel; and thus a quantity of steel remains in the vessel and is unusable. In order to keep this unusable quantity as small as practicable, it has become customary to provide sloping bottoms with a low point at or near the edge of the vessel where a pouring orifice is positioned. However, this has brought about a relative inefficiency in refractory brick installation and utilization.

The harsh and erosive properties of slag are well known; and in order to protect walls of a vessel in the vicinity of slag locations, a refractory brick that is more slag-resistant (and more expensive) than refractory bricks for contact with molten steel has been required. Thus, less expensive refractory bricks that are acceptable for use in contact with molten steel do not adequately withstand the rigors of on-going contact with slag. Accordingly, it has been customary to line the interior of a metallurgical vessel designed for use with molten steel (e.g., a ladle) with lesser cost refractory bricks in regions normally encountering mostly liquid steel, while installing the more costly bricks in regions expected to normally encounter slag. Since slag normally resides on the surface of the molten steel, such more costly bricks are used to line the upper region of the interior which usually is adjacent the mouth of the vessel.

For simplicity and cost effectiveness, it is customary to line the interior of a high temperature vessel with refractory bricks beginning at the bottom; and, after installing bricks overlying the bottom, to work upward to cover the interior walls with successive courses until the entire interior has been covered. It will thus be observed that if the bottom slopes, the successive rings of side wall bricks will also slope, forming rings that are tilted to follow the slope of the bottom. However, the surface of the liquid contents of the vessel will be horizontal, generally parallel to the plane containing the earth's natural surface at that location; and so the plane containing the liquid surface will lie at an angle to the planes of the successive rings of refractories. Accordingly, in order to ensure that normal contact between slag and refractories is in a region of the lining in which the more expensive bricks are installed, it has been necessary to provide several full or partial extra courses of such more expensive bricks.

Recognizing that sloped bottoms can increase the yield of metal recovered, it has been desired to modify essentially flat bottomed vessels to give them an effective sloped bottom to obtain larger recovery of uncontaminated metal.

Heretofore, the use of refractory castables or ramming mixes to compensate for the slope was generally unsatisfactory since cast or rammed fillers require extended, and hence costly, installation time.

SUMMARY OF THE INVENTION

The present invention has met the above described needs. The improvement according to the invention hereof includes the provision of one or more courses of one or more precast modules of refractories of coordinated and tapered heights to form correspondingly tapered compensating courses. In vessels of essentially circular or oval geometry, in which the tap hole is located at one side of the bottom, this results in the provision of an essentially circular ring which from a high point (where the bricks of the ring are the highest), tapers to a low point 180 degrees displaced therefrom where the modules of the ring are the lowest. Thus, the taper of the ring or rings compensates for the sloping bottom so that additional courses of refractories (i.e. for example, bricks or precast material) that are installed above the compensating precast module courses lie in planes generally parallel to the surfaces of both liquid metal and slag; and since the aforementioned relative angle therebetween is eliminated, only a minimum number of courses of the more expensive slag-resistant refractories are required to encompass expected slag contact regions, thus saving cost.

In vessels of essentially circular or oval geometry in which the tap hole may be located in the center of the bottom, the rings are formed of refractories whose upper surfaces are co-planar but whose bottom surfaces are tapered down inwardly so as to follow the downward slope of the interior of the vessel bottom.

In vessels having an essentially flat bottom, precast shapes can be utilized which will give the vessels a sloped bottom, which shapes can have integrally formed therewith sections which compensate for the sloping bottom so that courses of brick installed there above lie in planes generally parallel to both liquid metal and slag.

In modifications of the foregoing constructions, segments of the slope-compensating rings may be precast into one or more modules which then can be dropped into place within the vessel shell, thus reducing down-time and labor involved in re-lining vessels. In addition, as part of the prefabrication (i.e. precasting) of these modules, there may be included with each module a pro-rata part of the adjacent bottom lining which for a circular vessel would take the form of a truncated pie slice, truncated to provide the required bottom slope and with suitable openings for the exit nozzle and injection devices.

OBJECTS AND FEATURES OF THE INVENTION

It is one general object of the invention to improve high temperature refractory linings in metallurgical vessels.

It is another object of the invention to facilitate use of such vessels in which the bottoms are sloped to one side.

It is another object of the invention to reduce maintenance costs for high temperature linings for refractory lined vessels with sloping bottoms.

It is yet another object of the invention to reduce damage and down time for replacement of high temperature refractories resulting from slag attack or other causes.

Accordingly, in accordance with a feature of one embodiment of the invention, pluralities of individual refractory bricks are assembled to form courses having heights that are tapered to compensate for the slope angles of sloping bottoms, thus providing support for succeeding courses of refractories that are generally parallel to expected layers of erosive materials such as slag.

In accordance with another feature of the invention, the compensating course (or courses) may be positioned adjacent the sloping bottom of the vessel or part of the way up the sides, thus providing flexibility in installation.

In accordance with another feature of the invention, the aforementioned course arrangements may be installed in annular rings each of which, for circular vessels, may be configured in two 180 degree semicircles which are mirror images of each other, thus enhancing simplicity of installation.

In accordance with yet another feature of the invention, the annular rings may be prefabricated (i.e. precast) into one or more segments or modules and made ready for dropping into place within the vessel, thus reducing down time and expense.

In accordance with still another feature of the invention, one or more prefabricated (i.e. precast) segments or modules may optionally include adjacent segments of the vessel bottom refractories, thus further facilitating relinement of the vessel and additionally reducing vessel down time.

In accordance with yet one further feature of the invention, for vessels having a center tap hole, provision is made for refractories (which may be either installed individually or as one or more modules) whose upper surfaces are level and whose bottom surfaces taper inwardly and downwardly to follow the corresponding taper of the bottom of the vessel toward its tap hole.

BRIEF DESCRIPTION OF THE DRAWING

FIG. 6A' is a perspective view illustrating a single unit prefabricated module of a part of the half ring of FIG. 6;

FIG. 6B' is a perspective view illustrating a single unit prefabricated module of another part of the half ring of FIG. 6.

DETAILED DESCRIPTION OF THE INVENTION

While the instant invention is applicable to metallurgical vessels broadly, it will be described in connection with ladles.

Figure 1:
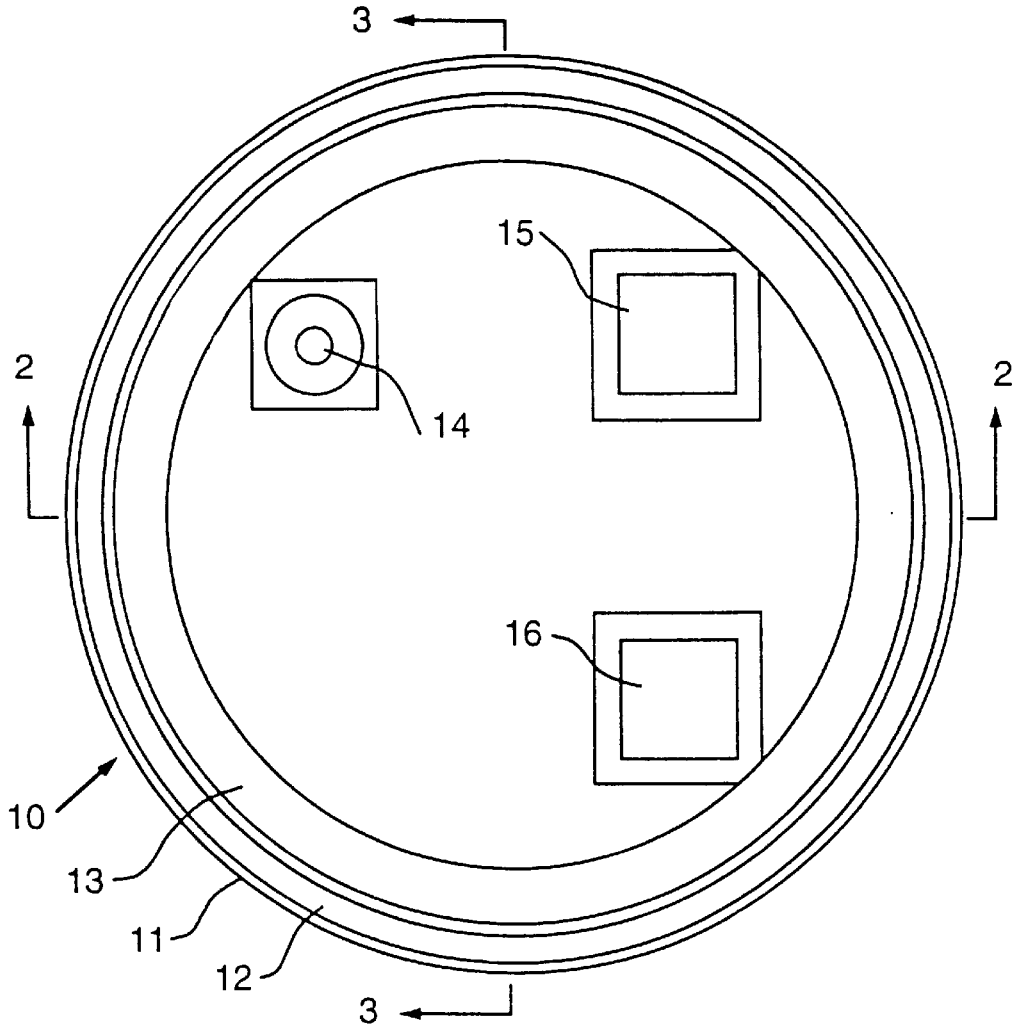
FIG. 1 is a top view of a typical refractory-lined vessel used for handling molten metal.

Now turning to the drawing, and more particularly FIG. 1 thereof, it will be seen to depict a typical circular metallurgical vessel, such as for example ladle 10 employed in the steel-making industry for handling molten metal such as, for example, steel. The vessel typically includes an outer metal shell 11, a first lining of refractory bricks 12, and an interior lining of refractory bricks 13. Included within the interior bottom are conventional tap hole 14, and injector locations 15 and 16. Injectors are not necessarily employed in all ladles. The tap hole is preferably located at or near the lowest point of the sloped bottom of the vessel which, in the embodiment of FIG. 1, is offset (as shown) from the center to a location adjacent the exterior wall. The offset for injectors 15 and 16 as shown in FIG. 1 is to accommodate other equipment.

Figure 2:
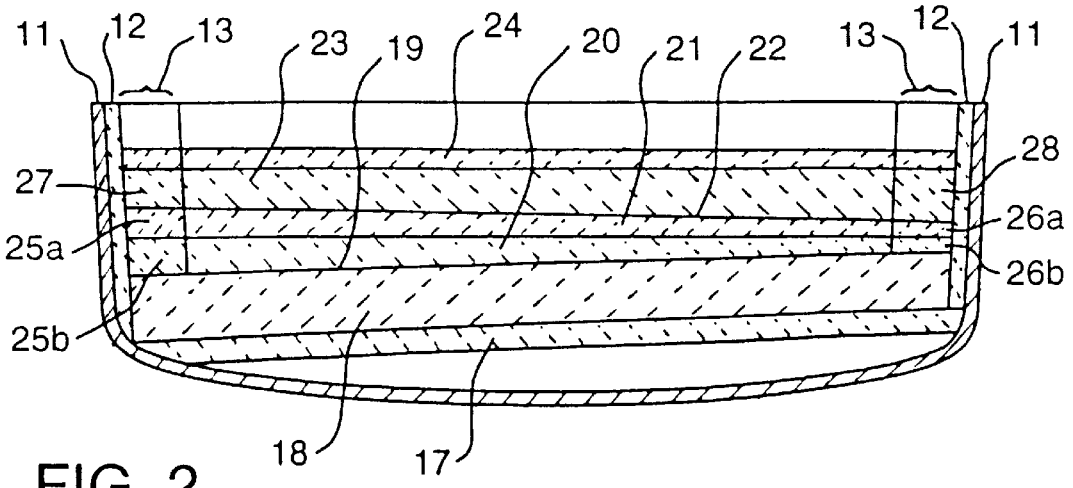
FIG. 2 is a partial sectional view taken along the section lines 2—2 of FIG. 1.
Figure 3:
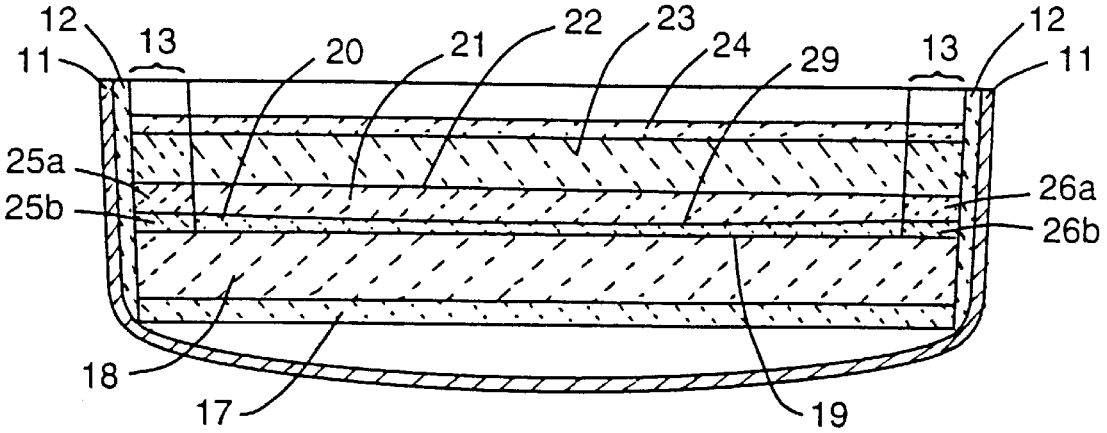
FIG. 3 is a partial sectional view taken along the section lines 3—3 of FIG. 1.

To further illustrate the interior of the metallurgical vessel shown in FIG. 1 and to depict the leveling courses of refractories constructed according to the instant invention, sections 2—2 and 3—3 are shown respectively in FIGS. 2 and 3. FIG. 2 shows two layers 17 and 18 of refractories that typically line the bottoms of high temperature metallurgical vessels such as, for example, liquid steel handling vessels. It will be observed that FIG. 2 shows these two layers 17 and 18 are each generally of uniform thickness and are installed to present a sloping upper surface 19 of element 18 which slopes down toward tap hole 14 (not shown) so as to facilitate draining of molten metal, for example, steel, from the vessel. As mentioned above, such sloping surface provides advantages. However, in order to provide the aforementioned leveling, the instant invention provides a pair of tapered layers 20 and 21 are installed so that the upper surface 22 of layer 21 is essentially level as shown in FIG. 2. Accordingly, FIG. 2 shows successive courses of bricks as represented by courses 23 and 24 are essentially parallel to the plane containing the mouth (not shown) of the vessel 10 so that the course of the more slag-resistant (and expensive) refractories described above need be of minimum height. If the dimensions of the ladle are such that the ends of the tapered layers 20 and 21 are not adjoining, they can be made to "communicate", i.e., form a ring with the use of transition refractories. At both ends of tapered layers 20 and 21 there are shown transition refractories 25*a*/25*b* and 26*a*/26*b*, respectively, which connect with the layers and abut conventional side wall refractories 27 and 28, respectively. Refractories 25*a*/25*b* and 26*a*/26*b* are splits or soaps which are not tapered and are of the same thickness (height) of the adjacent brick in the ring.

FIG. 3 shows the geometrical relationship of the foregoing courses of refractories at an angle of 90 degrees to that of FIG. 2; and like parts are, of course, identified with like symbols. There, the leveling courses 20 and 21 are shown, with surface 22 of layer 21 being essentially level, and with the line 29 between layers 20 and 21 reflecting the tapering and curved nature of the interior of the vessel.

Figure 4:
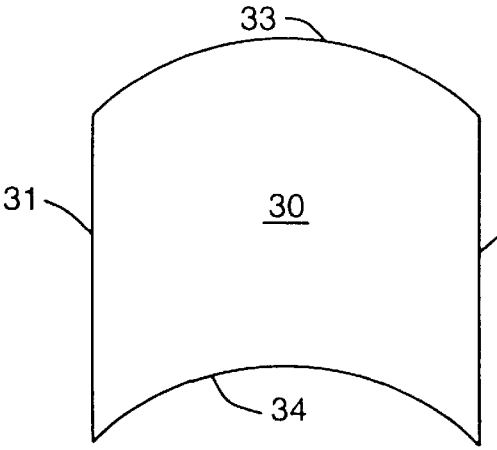
FIG. 4 is top view of a universal shape preferred for practicing the invention.
Figure 5A:
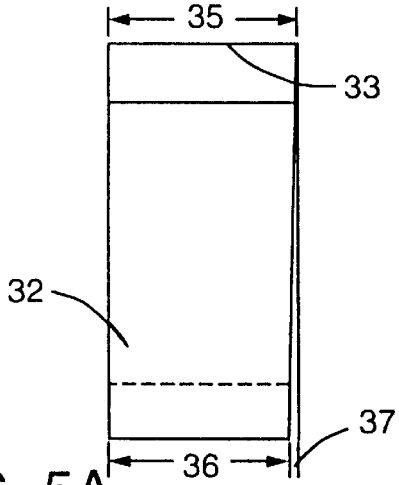
FIG. 5A is a side view of the shape of FIG. 4.
Figure 5B:
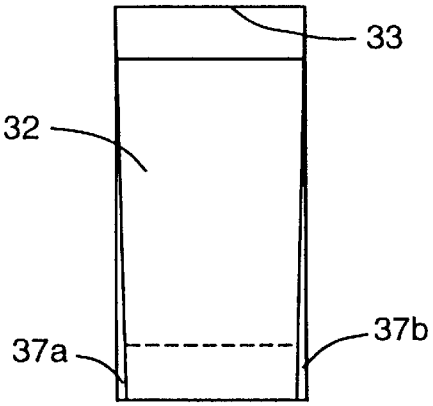
FIG. 5B is a side view of an alternative shape to that set forth in of FIG. 5A.

FIGS. 4, 5A and 5B show refractory shapes according to the first preferred embodiment of the instant invention. FIG. 4 is a top view of a particular universal shape 30 preferred for practicing the invention. Full universal shapes which have equal inner and outer faces are preferred since the same shapes can be used for the two half-rings. Semi-universal shapes are also suitable, but because of their thickness taper, they require "left" and "right" shapes having taper in opposite directions, or one of the mirror image half rings must be inverted. Also suitable are semi-universal key, circle, wedge brick, and the like. FIG. 4 shows that refractory shape 30 includes a pair of substantially parallel surfaces 31 and 32, together with a pair of curved surfaces 33 and 34 which are complementary and provide for form fitting of adjacent bricks as set forth in FIG. 6.

Figure 6:
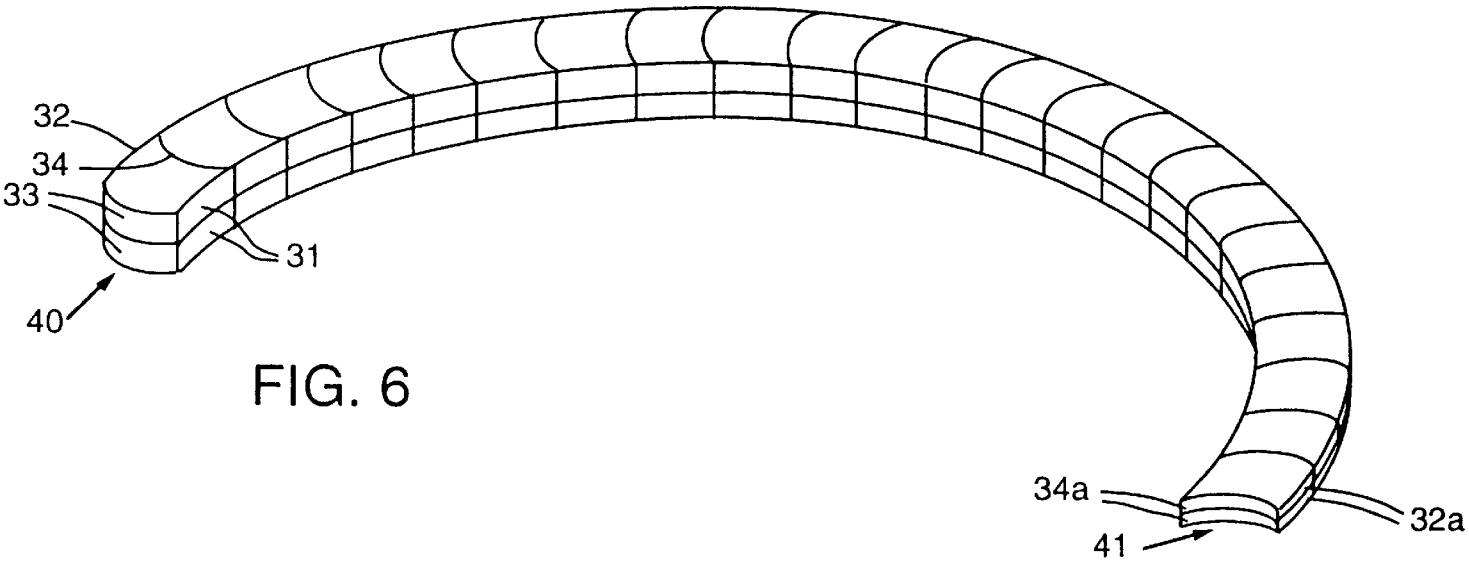
FIG. 6 is a perspective view illustrating one of two semicircular half rings of refractory bricks configured according to the invention.

FIG. 5A is a side view of the refractory brick of FIG. 4 and illustrates the gradual tapering feature that results in compensation as described herein. Thus, the height of the brick at end 33 as measured by dimension 35 is greater than the height of the brick at end 34 as measured by dimension 36; and the difference, as represented by dimension 37, results in a controlled taper in brick height which is progressive as set forth in FIG. 6. Thus, height of each brick in the representative half circle ring of FIG. 6 is different from each adjacent brick so as to result in a smooth taper from left end 40 to right end 41 as shown. Also, it should be observed that at right end 41, the much less high (shorter) refractories are shown and their relevant surfaces are identified by numerals 32*a* and 34*a*.

FIG. 5B illustrates another embodiment of the instant invention in that the taper as evidenced by dimension 37 of FIG. 5A is split into two parts 37*a* and 37*b* that is present at opposite surfaces.

It will be understood by those skilled in the art that in order for compensation (as described herein) of the instant invention to occur, the amount of taper is determined by the degree to which the bottom refractories 17 (FIG. 2) of the vessel 10 slope as evidenced by the slope of the upper surface of element 19 (FIG. 2). Therefore, the amount of taper from left end 40 to right end 41 (FIG. 6) will vary depending upon the taper of the bottom slope of the vessel.

FIG. 6 is a perspective view illustrating one of two semicircular half rings of semi-universal refractory bricks configured according to the invention, the complementary semicircular half ring being a mirror image of the half ring shown. FIG. 6 shows that there are two essentially identical courses of refractories, one overlying the other. To complete a full ring, the mirror image courses are adjoined at ends 40 and 41 to complete a circular installation as depicted in FIGS. 1–3. It will be understood by those skilled in the art that the number of courses of bricks will vary depending upon the slope of the vessel bottom and the taper of the bricks.

To join two half rings, "left" and "right" hand tapered brick is required. To avoid additional mold costs, a more practical approach is to cut the ends of both courses of both rings so that they mate at a plane vertical surface. If cutting is not possible, the gaps at the mating faces of the two half rings may be filled with monolithic refractory. This practice is not recommended but if impossible to avoid, a high strength refractory plastic or ramming mix should be used.

Figure 6A:
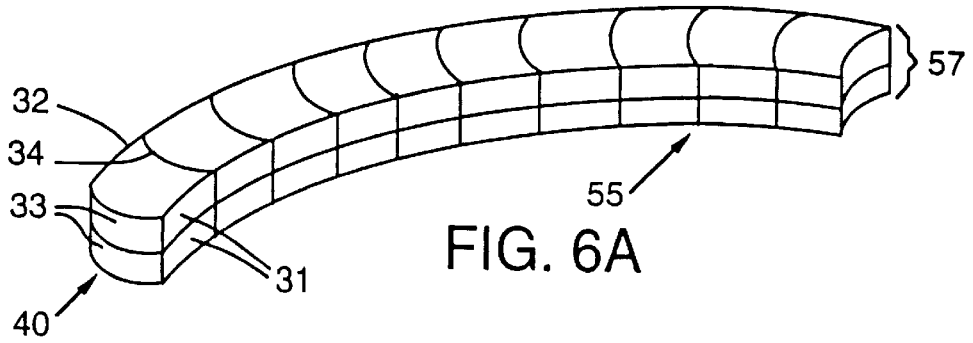
FIG. 6A is a perspective view illustrating a multi-unit prefabricated module of a part of the half ring of FIG. 6.
Figure 6B:
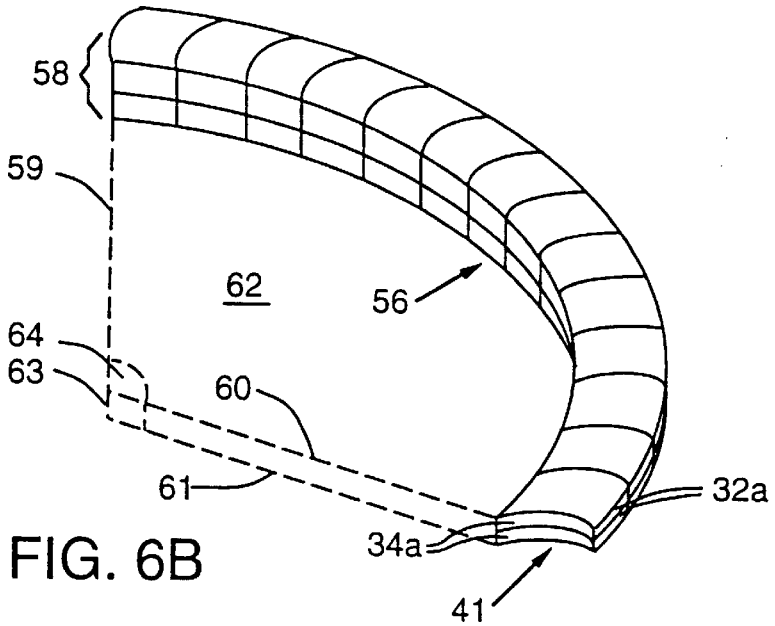
FIG. 6B is a perspective view illustrating a multi-unit prefabricated module of another part of the half ring of FIG. 6.

As mentioned herein, one of the features of the invention is its adaptability to modular prefabrication. FIGS. 6A and 6B illustrate multi-element modules 55 and 56 which when assembled together, form a half ring similar to that of FIG. 6. Thus, it will be appreciated by those skilled in the art that in order to assemble the modules of FIGS. 6A and 6B, ends identified with numerals 57 and 58 are brought into communication with each other.

Further examination of FIG. 6B reveals the presence of dashed lines 59, 60 and 61. These dashed lines represent an optional addition to the module of a pie-shaped segment 62 which comprises a pro-rate part of the refractory covering the bottom of the vessel. The apex 63 (FIG. 6B) of such pie-shaped segment may be truncated in embodiments having a center tap hole so as to remove the small region 64 and leave space for insertion of a refractory lined tap hole nozzle (not shown). It will be evident to those skilled in the art that a similar pie-shaped extension may be attached to each of the remaining modules such as, for example, module 55 (FIG. 6A).

The modules of FIGS. 6A and 6B may also be formed as unitary cast or rammed modules 55' and 56' (as depicted in FIGS. 6A' and 6B') which when assembled together, form a half ring similar to that of FIG. 6. Thus, in order to assemble the modules of FIGS. 6A' and 6B', ends identified with numerals 57' and 58' are brought into communication with each other.

Further examination of FIGS. 6A' and 6B' reveal the presence of dashed lines 59', 60' and 61'. These dashed lines (FIG. 6B) represent the above described optional addition to the module of a pie-shaped segment 62' which comprises a pro-rate part of the refractory covering the bottom of the vessel. The apex 63' of such pie-shaped segment may be truncated in embodiments having a center tap hole so as to remove the small region 64' and leave space for insertion of a refractory lined tap hole nozzle (not shown). It will be appreciated by those skilled in the art that a similar pie-shaped extension may be attached to each of the remaining modules such as, for example, module 55' (FIG. 6A').

Figure 7A:
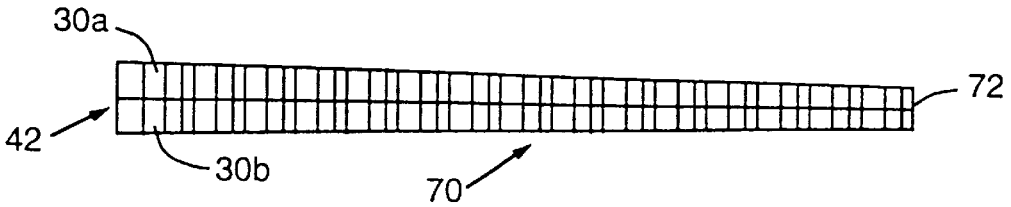
FIGS. 7, 7A and 7B are linear views (elevations) depicting a modification of FIG. 6 in which two courses of refractory bricks overlie one another for the principal part of the semicircle, while the thinner end is comprised of a single layer only.
Figure 7:
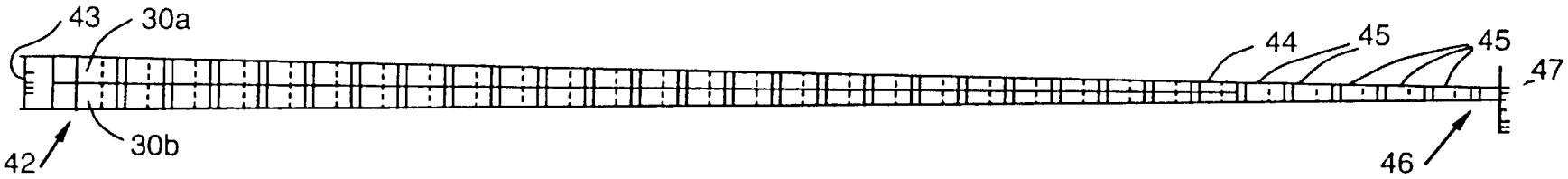

FIG. 7 is a side view depicting a modification of FIG. 6 in which two courses of bricks overlie one another for the principal part of the semicircle, while the thinner end is comprised of a single layer only. Thus at left end 42 the overlying nature of the courses is represented by overlying refractories 30*a* and 30*b* which in one illustrative embodiment result in a total course height at end 42, such as, for example but not limited to, about 8.5 inches, as shown by dimension 43. In this embodiment, the dual geometry of the courses continues to point 44 at which the total height has declined such that the remainder includes just one brick 45. In the illustration hereof, the height at end 46 has decreased to such as, for example but not limited to, 1.25 inches, as shown by dimension 47.

Figure 7B:
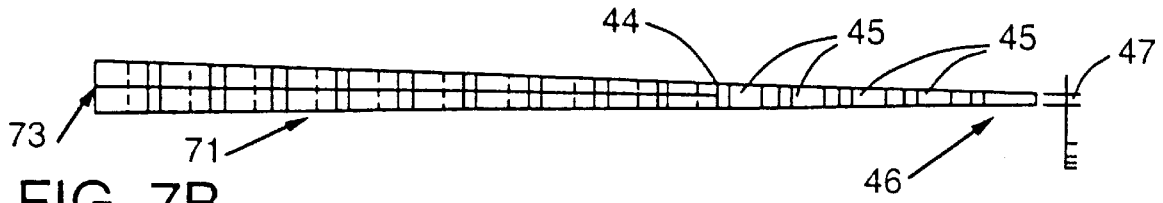

For embodiments corresponding to those of FIGS. 6A and 6B, there may be provided sections similar to sections 70 and 71 as shown in FIGS. 7A and 7B, respectively. There, ends 72 (FIG. 7A) and 73 (FIG. 7B) are brought into communication when the sections are assembled.

Figure 8A:
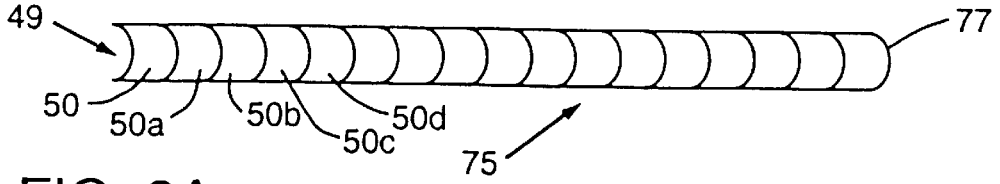
FIGS. 8, 8A and 8B show a top view illustrating tapered refractories of the general type shown in FIG. 4.
Figure 6A:
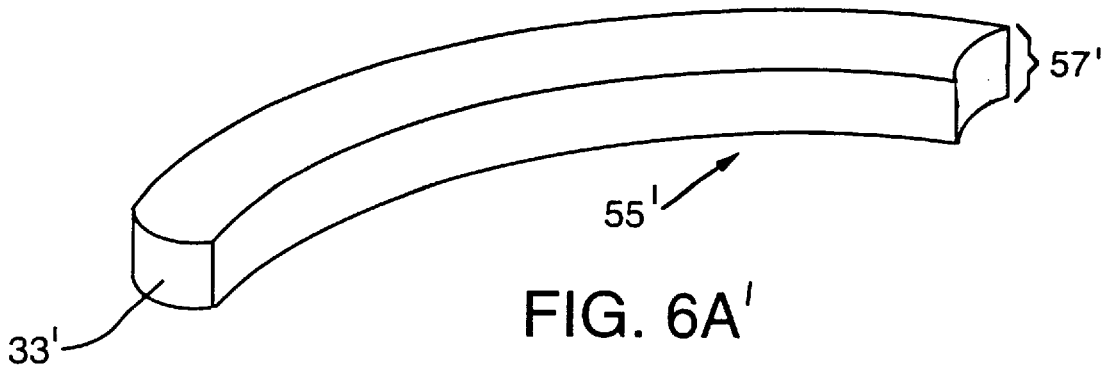
Figure 6B:
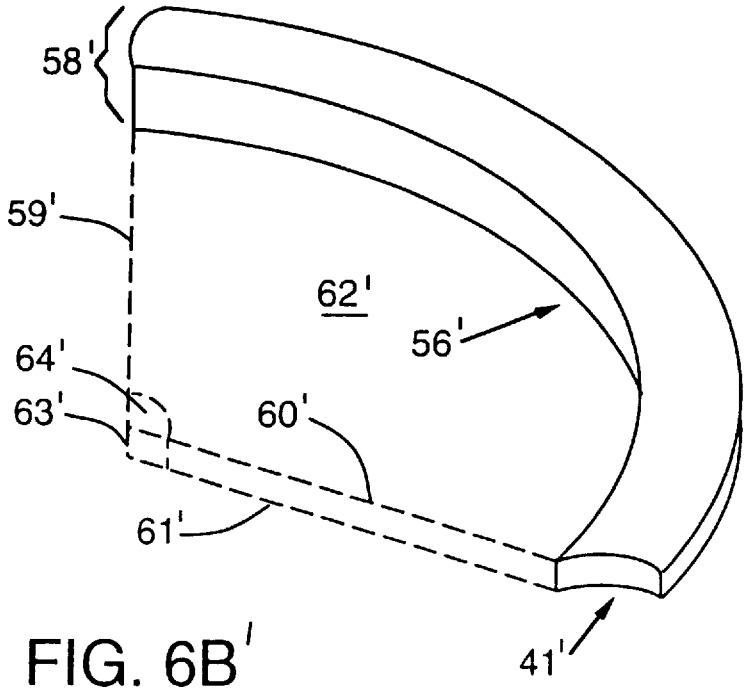
Figure 8:
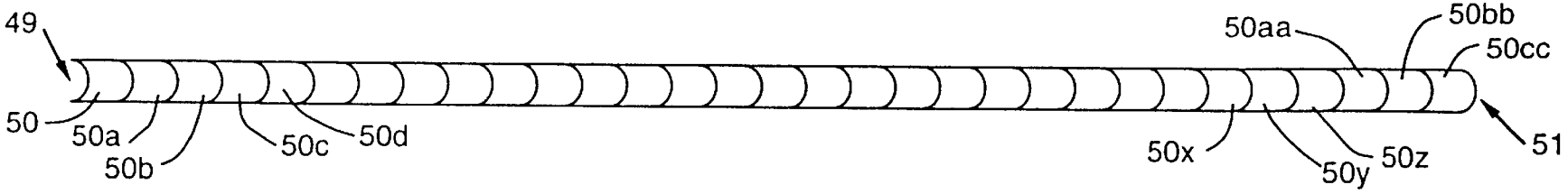

As mentioned herein, the principles of the invention may have applicability to non-circular vessels; and to illustrate such, there is included the array shown in FIG. 8. FIG. 8 shows a top view illustrating tapered refractories of the general type shown in FIG. 4. Beginning at the left end 49 of the array are courses 50-50*d* which continue to right end 51 which concludes with course 50*cc*. As with the configurations previously described, the degree of taper provided by refractories 50 through 50*cc* is complementary to the corresponding slope of the lower surface of the vessel in which they are to be installed so as to provide leveling compensation. Thus the principle can be applied to linings comprising both curved and plane surfaces.

Figure 8B:
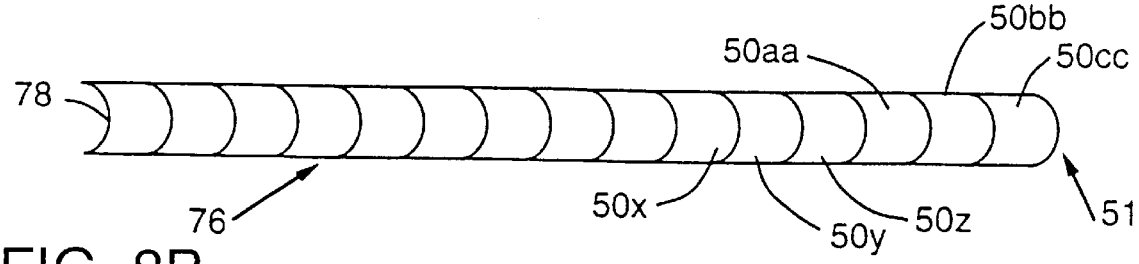

Again, to illustrate adaptability to modular prefabrication techniques, modules 75 (FIG. 8A) and 76 (FIG. 8B) are shown which, together, correspond to the array of FIG. 8. Again, as will be evident to those skilled in the art, assembly of the modules involves bringing ends 77 (FIG. 8A) and 78 (FIG. 8B) into communication with each other.

Figure 9:
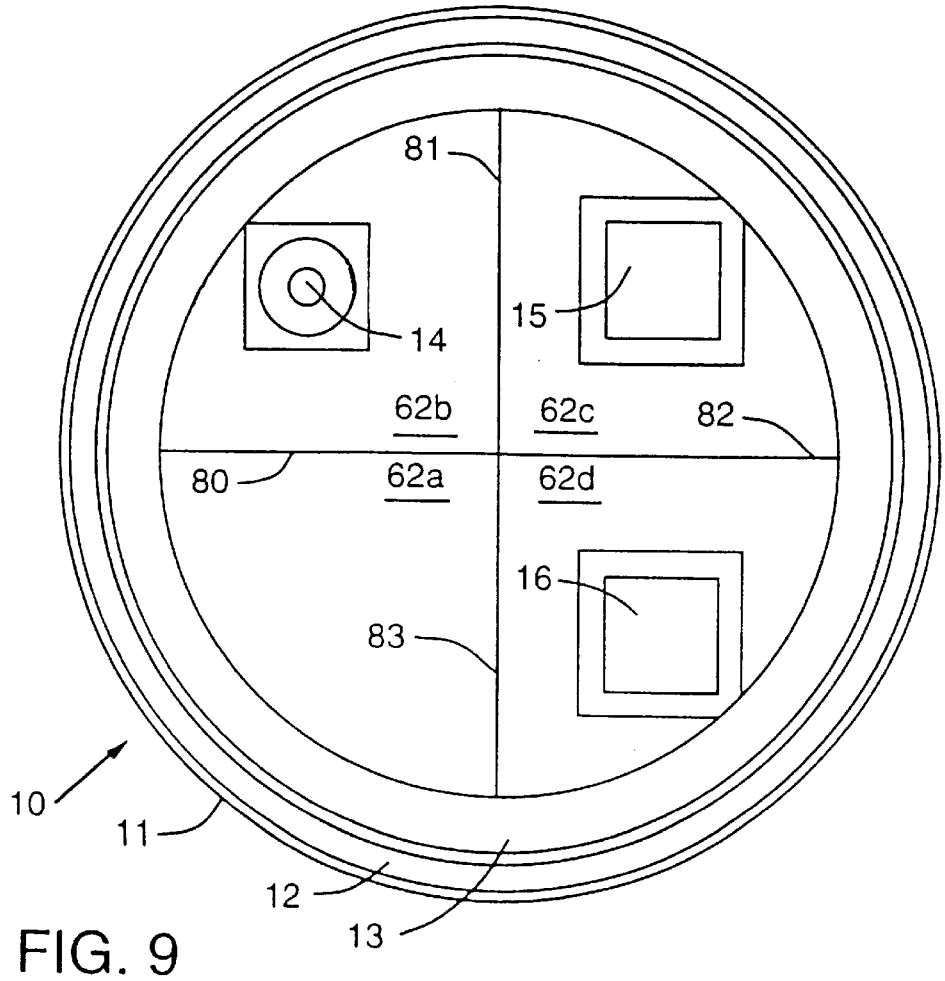
FIG. 9 is a top view of the vessel of FIG. 1 when quarter circular modules with bottom extensions are employed.

FIG. 9 sets forth a top view of the vessel of FIG. 1 when quarter circular modules with bottom extensions (such as those represented by the module 56' and extending bottom pie slice segment 62' of FIG. 6B') are in place, and showing the pie slice-like sections 62*a*–62*d* of the bottom refractory material. It will be appreciated by those skilled in the art that pie slice sections 62*b*, 62*c* and 62*d* are modified as needed to accommodate offset tap hole 14 and injector locations (i.e. injector ports) 15 and 16. It will also be appreciated that lines 80, 81, 82 and 83 (FIG. 9) represent the lines of communication between adjacent pie slices.

It will be understood by those skilled in the art that all of the precast module refractories discussed herein can be dimensioned slightly smaller than the diameters of the vessels into which they are placed to permit ease of insertion. Any resultant space between the vessel shell wall or safety refractory layer and the precast module of the present invention is simply filled with any conventional castable refractory which is rammed, cast, or gunned into place.

As will be appreciated by those skilled in this art, the precise dimensions of the precast module(s) of the instant invention may depend on the slope of the adjacent bottom surface of the vessel, the overall capacity of the vessel, and the possible positioning of geometrical objects such as, for example, a pouring impact pad and injector location(s). It will be understood by those skilled in the art that the geometries of the instant invention described herein provide an interconnected precast module refractory leveling assembly for improving the efficiency of refractory utilization in a metallurgical vessel.

Whereas particular embodiments of the instant invention have been described for the purposes of illustration, it will be evident to those skilled in the art that numerous variations and details of the instant invention may be made without departing from the instant invention as defined in the appended claims.

What is claimed is:

1. An interconnected refractory leveling assembly for a metallurgical vessel having a sloping bottom, comprising a first plurality of high temperature refractory precast modules assembled into a first partial ring and a second plurality of high temperature refractory precast modules assembled into a second partial ring, all of said precast modules having dimensions of height, width and length, each precast module of each partial ring having a sloping height and a median dimension of height different from each adjacent precast module in said each partial ring and wherein each said partial ring is a semicircle.

2. An interconnected refractory leveling assembly according to claim 1 in which said first partial ring is a first semicircle and said second partial ring is a second semicircle, in which said semicircles each have a first end and a second end, and in which said first end of said first semicircle is in communication with said first end of said second semicircle and said second end of said first semicircle is in communication with said second end of said second semicircle to form one complete circle.

3. An interconnected refractory leveling assembly according to claim 1 in which adjoining precast modules of each partial ring have an identical median dimension of length.

4. An interconnected refractory leveling assembly for a metallurgical vessel having a sloping bottom, comprising a first plurality of high temperature refractory precast modules assembled into a first partial ring and a second plurality of high temperature refractory precast modules assembled into a second partial ring, all of said precast modules having dimensions of height, width and length, each precast module of each partial ring having a sloping height and a median dimension of height different from each adjacent precast module in said each partial ring and in which said first partial ring is a first semicircle and said second partial ring is a second semicircle, in which said semicircles each have a first end and a second end, and in which said first end of said first semicircle is in communication with said first end of said second semicircle and said second end of said first semicircle is in communication with said second end of said second semicircle to form one complete circle, and in which said heights of adjoining ends of said precast modules at adjoining ends of said first and said second semicircles are essentially identical.

5. An interconnected refractory leveling assembly for a metallurgical vessel having a sloping bottom, comprising a first plurality of high temperature refractory precast modules assembled into a first partial ring and a second plurality of high temperature refractory precast modules assembled into a second partial ring, all of said modules having dimensions of height, width and length, each precast module of each partial ring having a sloping height and a median dimension of height different from each adjacent precast module in said each partial ring, further including at least one additional level of at least one leveling refractory precast module overlying said first partial ring and said second partial ring to further compensate for said sloping bottom.

6. An interconnected refractory leveling assembly according to claim 5 in which two courses of precast modules overlie one another for the principal part of a semicircle and for the remainder of said semicircle there is only a single layer of at least one precast module.

7. A vessel for containing high temperature molten metal, said vessel having (a) a supporting shell with side walls and a sloping bottom to form an interior for containing said molten metal, said interior of said vessel including a lining of refractory bricks, and (b) an interconnected refractory leveling assembly comprising a first plurality of high temperature refractory precast modules assembled into a first partial ring and a second plurality of high temperature refractory precast modules assembled into a second partial ring, all of said precast modules having dimensions of height, width and thickness, and wherein each precast module of each partial ring having a sloping height and a median dimension of height different from each adjacent precast module in said each partial ring.

8. A vessel according to claim 7 in which said interconnected refractory leveling assembly is located adjacent said bottom of said vessel.

9. A vessel according to claim 7 in which adjoining precast modules of each partial ring have an identical median dimension of length.

10. A vessel according to claim 7 in which all of said precast modules of said partial rings are essentially identical in width and length.

11. A vessel according to claim 7 in which each partial ring is a semicircle.

12. A vessel according to claim 7 wherein said vessel is essentially circular.

13. A vessel according to claim 7 in which said first partial ring and said second partial ring are mirror images of each other.

14. A vessel according to claim 7 wherein said vessel is annular.

15. A vessel according to claim 7 in which said first partial ring is a first semicircle and said second partial ring is a second semicircle, in which said semicircles each have a first end and a second end, and in which said first end of said first semicircle is in communication with said first end of said second semicircle and said second end of said first semicircle is in communication with said second end of said second semicircle to form one complete circle.

16. A vessel for containing high temperature molten metal, said vessel having (a) a supporting shell with side walls and a sloping bottom to form an interior for containing said molten metal, said interior of said vessel including a lining of refractory bricks, and (b) an interconnected refractory leveling assembly comprising a first plurality of high temperature refractory precast modules assembled into a first partial ring and a second plurality of high temperature refractory precast modules assembled into a second partial ring, all of said precast modules having dimensions of height, width and thickness, each precast module of each partial ring having a sloping height and a median dimension of height different from each adjacent precast module in said each partial ring, in which said first partial ring is a first semicircle and said second partial ring is a second semicircle, in which said semicircles each have a first end and a second end, and in which said first end of said first semicircle is in communication with said first end of said second semicircle and said second end of said first semicircle is in communication with said second end of said second semicircle to form one complete circle, and in which said heights of adjoining ends of said precast modules at adjoining ends of said first and said second semicircles are essentially identical.

17. A vessel for containing high temperature molten metal, said vessel having (a) a supporting shell with side walls and a sloping bottom to form an interior for containing said molten metal, said interior of said vessel including a lining of refractory bricks, and (b) an interconnected refractory leveling assembly comprising a first plurality of high temperature refractory precast modules assembled into a first partial ring and a second plurality of high temperature refractory precast modules assembled into a second partial ring, all of said precast modules having dimensions of height, width and thickness, each precast module of each partial ring having a sloping height and a median dimension of height different from each adjacent precast module in said each partial ring, further including at least one additional level of at least one leveling refractory precast module overlying said first partial ring and said second partial ring to further compensate for said sloping bottom of said vessel.

18. A vessel according to claim 17 in which two courses of precast modules overlie one another for the principal part of a semicircle and for the remainder of said semicircle there is only a single layer of at least one precast module.

* * * * *